US006752215B2

(12) United States Patent
Maguire et al.

(10) Patent No.: US 6,752,215 B2
(45) Date of Patent: Jun. 22, 2004

(54) METHOD AND APPARATUS FOR EXPANDING AND SEPARATING TUBULARS IN A WELLBORE

(75) Inventors: Patrick G. Maguire, Cypress, TX (US); Robert J. Coon, Missouri City, TX (US); Neil Andrew Abercrombie Simpson, Scotland (GB)

(73) Assignee: Weatherford/Lamb, Inc., Houston, TX (US)

( * ) Notice: Subject to any disclaimer, the term of this patent is extended or adjusted under 35 U.S.C. 154(b) by 192 days.

(21) Appl. No.: 09/969,089

(22) Filed: Oct. 2, 2001

(65) Prior Publication Data

US 2003/0062171 A1 Apr. 3, 2003

Related U.S. Application Data

(63) Continuation-in-part of application No. 09/469,690, filed on Dec. 22, 1999.

(51) Int. Cl.[7] ..... E21B 19/16

(52) U.S. Cl. ..... 166/380; 166/207; 166/55.7

(58) Field of Search ..... 166/380, 207, 166/206, 212, 216, 217, 297, 55, 35.7

(56) References Cited

U.S. PATENT DOCUMENTS

| | | | | |
|---|---|---|---|---|
| 761,518 | A | 5/1904 | Lykken | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,930,825 | A | 10/1933 | Raymond | |
| 1,981,525 | A | 11/1934 | Price | 166/4 |
| 2,175,372 | A | * 10/1939 | Allen | 166/55.7 |
| 2,214,226 | A | 9/1940 | English | 166/1 |

(List continued on next page.)

FOREIGN PATENT DOCUMENTS

| | | | |
|---|---|---|---|
| EP | 0 961 007 | 12/1999 | E21B/33/10 |
| GB | 1 448 304 | 9/1976 | E21B/33/13 |
| GB | 2 216 926 | 10/1989 | E21B/7/20 |
| GB | 2 320 734 | 7/1998 | E21B/33/127 |
| GB | 2 329 918 | 4/1999 | E21B/43/10 |
| GB | 2 345 308 | 7/2000 | E21B/43/10 |
| WO | WO 93/24728 | 12/1993 | E21B/17/10 |
| WO | WO 99/18328 | 4/1999 | E21B/23/01 |
| WO | WO 99/23354 | 5/1999 | E21B/43/10 |
| WO | WO 00/37772 | 6/2000 | E21B/43/10 |

OTHER PUBLICATIONS

International Search Report, International Application No. PCT/GB 02/04368, dated Jan. 3, 2003.

(List continued on next page.)

*Primary Examiner*—David Bagnell
*Assistant Examiner*—Jennifer R Dougherty
(74) *Attorney, Agent, or Firm*—Moser, Patterson & Sheridan, L.L.P.

(57) ABSTRACT

An apparatus and method for expanding a lower string of casing into frictional contact with an upper string of casing, and thereby hanging the lower string of casing onto the upper string of casing is provided. The apparatus essentially defines a lower string of casing having a scribe placed into the top end thereof. The lower string of casing is run into the wellbore, and positioned so that the top end overlaps with the bottom end of an upper string of casing already cemented into the wellbore. The top end of the lower casing string is expanded below the depth of the scribe into frictional contact with the upper string of casing. At the same time, or shortly thereafter, the top end of the upper string of casing is expanded. As the portion of the lower casing string having the scribe is expanded, the casing severs into upper and lower portions. The upper portion can then be removed from the wellbore, leaving a lower string of casing expanded into frictional engagement with an upper string of casing.

28 Claims, 9 Drawing Sheets

U.S. PATENT DOCUMENTS

| | | | | |
|---|---|---|---|---|
| 2,216,226 | A | 10/1940 | Bumpous | 36/44 |
| 2,383,214 | A | 8/1945 | Prout | 153/82 |
| 2,499,630 | A | 3/1950 | Clark | 153/81 |
| 2,627,891 | A | 2/1953 | Clark | 153/82 |
| 2,663,073 | A | 12/1953 | Bieber et al. | 29/148 |
| 2,898,971 | A | 9/1959 | Hempel | 153/82 |
| 3,087,546 | A | 4/1963 | Wooley | 166/46 |
| 3,191,677 | A | 6/1965 | Kinley | 166/14 |
| 3,191,680 | A | 6/1965 | Vincent | 166/46 |
| 3,195,646 | A | 7/1965 | Brown | 166/208 |
| 3,467,180 | A | 9/1969 | Pensotti | 165/180 |
| 3,712,376 | A | 1/1973 | Owen et al. | 166/277 |
| 3,776,307 | A | 12/1973 | Young | 166/125 |
| 3,818,734 | A | 6/1974 | Bateman | 72/75 |
| 3,911,707 | A | 10/1975 | Minakov et al. | 72/76 |
| 3,948,321 | A | 4/1976 | Owen et al. | 166/277 |
| 4,069,573 | A | 1/1978 | Rogers, Jr. et al. | 29/421 R |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,319,393 | A | 3/1982 | Pogonowski | 29/434 |
| 4,324,407 | A | 4/1982 | Upham et al. | 277/27 |
| 4,429,620 | A | 2/1984 | Burkhardt et al. | 91/395 |
| 4,483,399 | A | 11/1984 | Colgate | 166/308 |
| 4,509,777 | A | 4/1985 | Walker | 285/286 |
| 4,531,581 | A | 7/1985 | Pringle et al. | 166/120 |
| 4,538,442 | A | 9/1985 | Reed | 72/367 |
| 4,588,030 | A | 5/1986 | Blizzard | 166/120 |
| 4,697,640 | A | 10/1987 | Szarka | 166/120 |
| 4,723,905 | A | 2/1988 | Vassallo et al. | 425/392 |
| 4,848,469 | A | 7/1989 | Baugh et al. | 166/382 |
| 5,052,483 | A | 10/1991 | Hudson | 166/55 |
| 5,271,472 | A | 12/1993 | Leturno | 175/107 |
| 5,348,095 | A | 9/1994 | Worrall et al. | 166/380 |
| 5,409,059 | A | 4/1995 | McHardy | 166/208 |
| 5,435,400 | A | 7/1995 | Smith | 175/61 |
| 5,472,057 | A | 12/1995 | Winfree | 175/57 |
| 5,560,426 | A | 10/1996 | Trahan et al. | 166/120 |
| 5,685,369 | A | 11/1997 | Ellis et al. | 166/195 |
| 5,901,787 | A | 5/1999 | Boyle | 166/135 |
| 6,000,482 | A | 12/1999 | Michalski | 175/57 |
| 6,012,523 | A | 1/2000 | Campbell et al. | 166/277 |
| 6,021,850 | A | 2/2000 | Wood et al. | 166/380 |
| 6,029,748 | A | 2/2000 | Forsyth et al. | 166/380 |
| 6,053,247 | A | 4/2000 | Wesson et al. | 166/297 |
| 6,098,717 | A | 8/2000 | Bailey et al. | 166/382 |
| 6,446,323 | B1 | 9/2002 | Metcalfe et al. | 29/523 |
| 6,446,724 | B2 | 9/2002 | Baugh et al. | 166/285 |
| 6,457,532 | B1 | 10/2002 | Simpson | 166/380 |
| 2001/0045284 | A1 | 11/2001 | Simpson et al. | 166/313 |

OTHER PUBLICATIONS

PCT International Preliminary Examination Report from PCT/GB99/04365, Dated Mar. 23, 2001.

Partial International Search Report from PCT/GB00/04160, Dated Feb. 2, 2001.

UK Search Report from GB 9930398.4, Dated Jun. 27, 2000.

UK Search Report from GB 9930166.5, Dated Jun. 12, 2000.

U.S. patent application Ser. No. 09/949,986, Maguire, et al., filed Sep. 10, 2001.

U.S. patent application Ser. No. 09/949,057, Coon, filed Sep. 7, 2001.

U.S. patent application Ser. No. 09/946,196, Lauritzen, et al., filed Sep. 5, 2001.

U.S. patent application Ser. No. 09/938,176, Coon, filed Aug. 23, 2001.

U.S. patent application Ser. No. 09/938,168, Coon, filed Aug. 23, 2001.

U.S. patent application Ser. No. 09/848,900, Haugen, et al., filed May 4, 2001.

U.S. patent application Ser. No. 09/828,508, Simpson, et al., filed Apr. 6, 2001.

U.S. patent application Ser. No. 09/712,789, Simpson, et al., filed Nov. 13, 2000.

U.S. patent application Ser. No. 09/470,176, Metcalfe, et al., filed Dec. 22, 1999.

U.S. patent application Ser. No. 09/470,154, Metcalfe, et al., filed Dec. 22, 1999.

U.S. patent application Ser. No. 09/469,692, Trahan, filed Dec. 22, 1999.

PCT International Search Report from PCT/GB99/04246, Dated Mar. 3, 2000.

PCT International Search Report from PCT/GB99/04365, Dated Mar. 3, 2000.

U.S. patent application Ser. No. 09/469,690, Abercrombie, filed Dec. 22, 1999.

U.S. patent application Ser. No. 09/469,643, Metcalfe, et al., filed Dec. 22, 1999.

U.S. patent application Ser. No. 09/469,526, Metcalfe, et al., filed Dec. 22, 1999.

U.S. patent application Ser. No. 09/469,681, Metcalfe, et al., filed Dec. 22, 1999.

* cited by examiner

METHOD AND APPARATUS FOR EXPANDING AND SEPARATING TUBULARS IN A WELLBORE

This application is a continuation-in-part of co-pending United States Patent Application No. 09/469,690, which was filed on Dec. 22, 1999, and is incorporated by reference herein.

BACKGROUND OF THE INVENTION

1. Field of the Invention

The present invention relates to methods and apparatus for wellbore completions. More particularly, the invention relates to completing a wellbore by expanding tubulars therein. More particularly still, the invention relates to completing a wellbore by separating an upper portion of a tubular from a lower portion after the lower portion of the tubular has been expanded into frictional engagement with another tubular there around.

2. Description of the Related Art

Hydrocarbon and other wells are completed by forming a borehole in the earth and then lining the borehole with steel pipe or casing to form a wellbore. After a section of wellbore is formed by drilling, a section of casing is lowered into the wellbore and temporarily hung therein from the surface of the well. Using apparatus known in the art, the casing is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. In this respect, the first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps the lower portion of the first string of casing. The second liner string is then fixed or "hung off of the existing casing by the use of slips which utilize slip members and cones to wedgingly fix the new string of liner in the wellbore. The second casing string is then cemented. This process is typically repeated with additional casing strings until the well has been drilled to total depth. In this manner, wells are typically formed with two or more strings of casing of an ever decreasing diameter.

Apparatus and methods are emerging that permit tubulars to be expanded in situ. The apparatus typically includes expander tools which are fluid powered and are run into a wellbore on a working string. The hydraulic expander tools include radially expandable members which, through fluid pressure, are urged outward radially from the body of the expander tool and into contact with a tubular therearound. As sufficient pressure is generated on a piston surface behind these expansion members, the tubular being acted upon by the expansion tool is expanded past its point of plastic deformation. In this manner, the inner and outer diameter of the tubular is increased in the wellbore. By rotating the expander tool in the wellbore and/or moving the expander tool axially in the wellbore with the expansion member actuated, a tubular can be expanded along a predetermined length in a wellbore.

There are advantages to expanding a tubular within a wellbore. For example, expanding a first tubular into contact with a second tubular therearound eliminates the need for a conventional slip assembly. With the elimination of the slip assembly, the annular space required to house the slip assembly between the two tubulars can be reduced.

In one example of utilizing an expansion tool and expansion technology, a liner can be hung off of an existing string of casing without the use of a conventional slip assembly. A new section of liner is run into the wellbore using a run-in string. As the assembly reaches that depth in the wellbore where the liner is to be hung, the new liner is cemented in place. Before the cement sets, an expander tool is actuated and the liner is expanded into contact with the existing casing therearound. By rotating the expander tool in place, the new lower string of casing can be fixed onto the previous upper string of casing, and the annular area between the two tubulars is sealed.

There are problems associated with the installation of a second string of casing in a wellbore using an expander tool. Because the weight of the casing must be borne by the run-in string during cementing and expansion, there is necessarily a portion of surplus casing remaining above the expanded portion. In order to properly complete the well, that section of surplus unexpanded casing must be removed in order to provide a clear path through the wellbore in the area of transition between the first and second casing strings.

Known methods for severing a string of casing in a wellbore present various drawbacks. For example, a severing tool may be run into the wellbore that includes cutters which extend into contact with the tubular to be severed. The cutters typically pivot away from a body of the cutter. Thereafter, through rotation the cutters eventually sever the tubular. This approach requires a separate trip into the wellbore, and the severing tool can become binded and otherwise malfunction. The severing tool can also interfere with the upper string of casing. Another approach to severing a tubular in a wellbore includes either explosives or chemicals. These approaches likewise require a separate trip into the wellbore, and involve the expense and inconvenience of transporting and using additional chemicals during well completion. These methods also create a risk of interfering with the upper string of casing. Another possible approach is to use a separate fluid powered tool, like an expansion tool wherein one of the expansion members is equipped with some type of rotary cutter. This approach, however, requires yet another specialized tool and manipulation of the run-in string in the wellbore in order to place the cutting tool adjacent that part of the tubular to be severed. The approach presents the technical problem of operating two expansion tools selectively with a single tubular string.

There is a need, therefore, for an improved apparatus and method for severing an upper portion of a string of casing after the casing has been set in a wellbore by expansion means. There is a further need for an improved method and apparatus for severing a tubular in a wellbore. There is yet a further need for a method and apparatus to quickly and simply sever a tubular in a wellbore without a separate trip into the wellbore and without endangering the integrity of the upper string of casing.

SUMMARY OF THE INVENTION

The present invention provides methods and apparatus for completing a wellbore. According to the present invention, an expansion assembly is run into a wellbore on a run-in string. The expansion assembly comprises a lower string of casing to be hung in the wellbore, and an expander tool disposed at an upper end thereof. The expander tool preferably includes a plurality of expansion members which are radially disposed around a body of the tool in a spiraling arrangement. In addition, the lower string of casing includes a scribe placed in the lower string of casing at the point of desired severance. The scribe creates a point of structural weakness within the wall of the casing so that it fails upon expansion.

The expander tool is run into the wellbore to a predetermined depth where the lower string of casing is to be hung. In this respect, a top portion of the lower string of casing, including the scribe, is positioned to overlap a bottom portion of an upper string of casing already set in the wellbore. In this manner, the scribe in the lower string of casing is positioned downhole at the depth where the two strings of casing overlap. Cement is injected through the run-in string and circulated into the annular area between the lower string of casing and the formation. Cement is further circulated into the annulus where the lower and upper strings of casing overlap. Before the cement cures, the expansion members at a lower portion of the expansion tool are actuated so as to expand the lower string of casing into the existing upper string at a point below the scribe. As the uppermost expansion members extend radially outward into contact with the casing, including those at the depth of the scribe, the scribe causes the casing to be severed. Thereafter, with the lower string of casing expanded into frictional and sealing relationship with the existing upper casing string, the expansion tool and run-in string, are pulled from the wellbore.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 7 further depicts the lower string of casing having been severed into an upper portion and a lower portion due to expansion.

DETAILED DESCRIPTION OF THE PREFERRED EMBODIMENT

Figure 1:
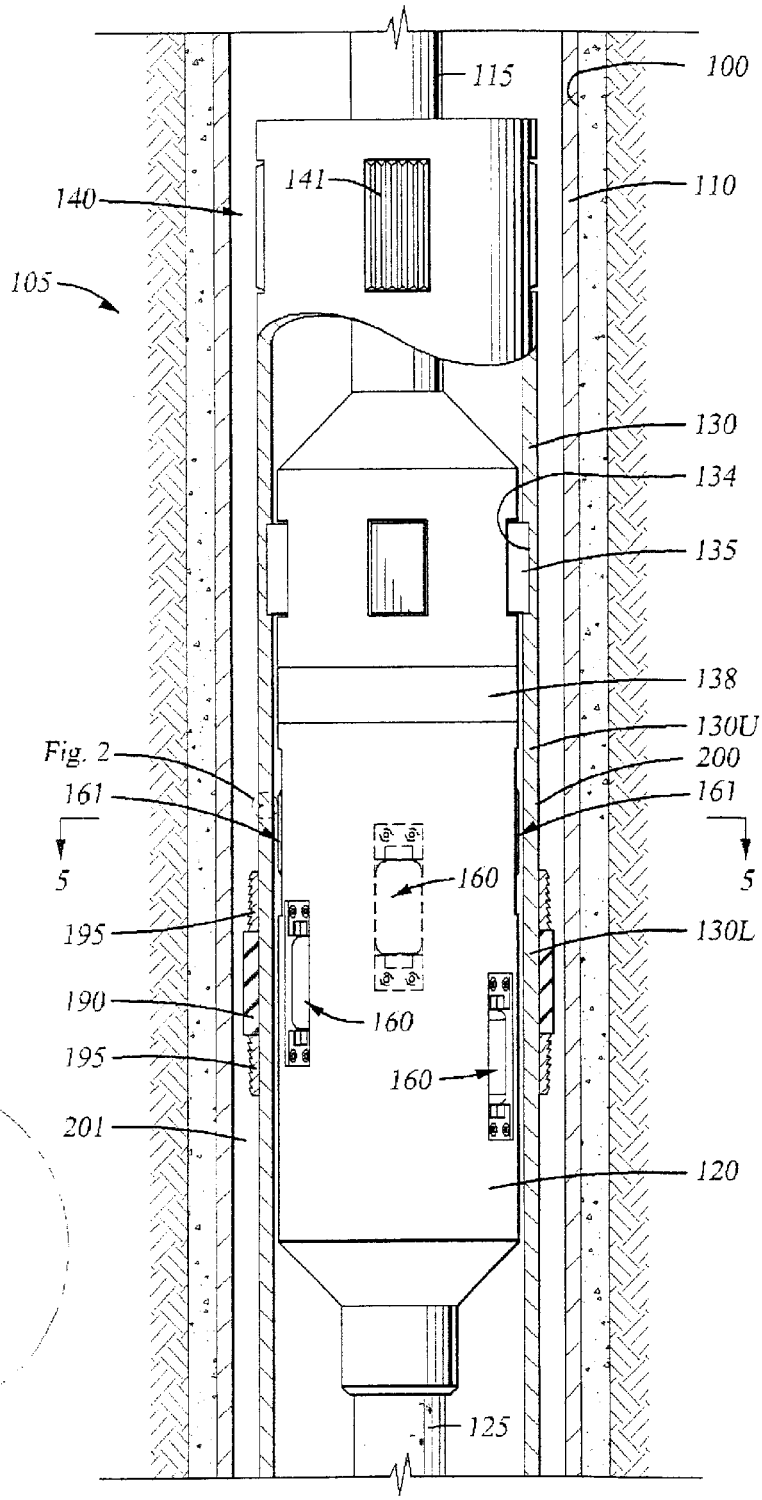
FIG. 1 is a partial section view of a wellbore illustrating the assembly of the present invention in a run-in position.

FIG. 1 is a section view of a wellbore 100 illustrating an apparatus 105 for use in the methods of the present invention. The apparatus 105 essentially defines a string of casing 130, and an expander tool 120 for expanding the string of casing 130. By actuation of the expander tool 120 against the inner surface of the string of casing 130, the string of casing 130 is expanded into a second, upper string of casing 110 which has already been set in the wellbore 100. In this manner, the top portion of the lower string of casing 130U is placed in frictional engagement with the bottom portion of the string of casing 110.

Figure 2:
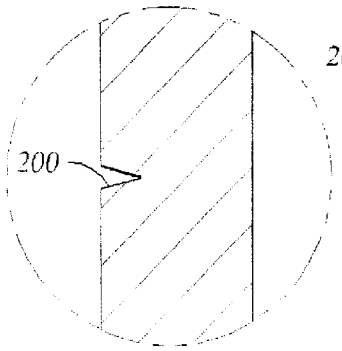
FIG. 2 is an enlarged sectional view of a wall in the lower string of casing more fully showing one embodiment of a scribe of the present invention.

In accordance with the present invention, a scribe 200 is placed into the surface of the lower string of casing 130. An enlarged view of the scribe 200 in one embodiment is shown in FIG. 2. As will be disclosed in greater detail, the scribe 200 creates an area of structural weakness within the lower casing string 130. When the lower string of casing 130 is expanded at the depth of the scribe 200, the lower string of casing 130 is severed into upper 130U and lower 130L portions. The upper portion 130U of the lower casing string 130 can then be easily removed from the wellbore 100. Thus, the scribe may serve as a release mechanism for the lower casing string 130.

At the stage of completion shown in FIG. 1, the wellbore 100 has been lined with the upper string of casing 110. A working string 115 is also shown in FIG. 1. Attached to a lower end of the run-in string 115 is an expander tool 120. Also attached to the working string 115 is the lower string of casing 130. In the embodiment of FIG. 1, the lower string of casing 130 is supported during run-in by a series of dogs 135 disposed radially about the expander tool 120. The dogs 135 are landed in a circumferential profile 134 within the upper string of casing 130.

A sealing ring 190 is disposed on the outer surface of the lower string of casing 130. In the preferred embodiment, the sealing ring 190 is an elastomeric member circumferentially fitted onto the outer surface of the casing 130. However, non-elastomeric materials may also be used. The sealing ring 190 is designed to seal an annular area 201 formed between the outer surface of the lower string of casing 130 and the inner surface of the upper string of casing 110 upon expansion of the lower string 130 into the upper string 110.

Also positioned on the outer surface of the lower string of casing 130 is at least one slip member 195. In the preferred embodiment of the apparatus 105, the slip member 195 defines a pair of rings having grip surfaces formed thereon for engaging the inner surface of the upper string of casing 110 when the lower string of casing 130 is expanded. In the embodiment shown in FIG. 1, one slip ring 195 is disposed above the sealing ring 190, and one slip ring 195 is disposed below the sealing ring 190. In FIG. 1, the grip surface includes teeth formed on each slip ring 195. However, the slips could be of any shape and the grip surfaces could include any number of geometric shapes, including button-like inserts (not shown) made of high carbon material.

Fluid is circulated from the surface and into the wellbore 100 through the working string 115. A bore 168, shown in FIG. 3, runs through the expander tool 120, placing the working string 115 and the expander tool 120 in fluid communication. A fluid outlet 125 is provided at the lower end of the expander tool 120. In the preferred embodiment, shown in FIG. 1, a tubular member serves as the fluid outlet 125. The fluid outlet 125 serves as a fluid conduit for cement to be circulated into the wellbore 100 in accordance with the method of the present invention.

In the embodiment shown in FIG. 1, the expander tool 120 includes a swivel 138. The swivel 138 allows the expander tool 120 to be rotated by the working tubular 115 while the supporting dogs 135 remain stationary.

Figures 3, 4:
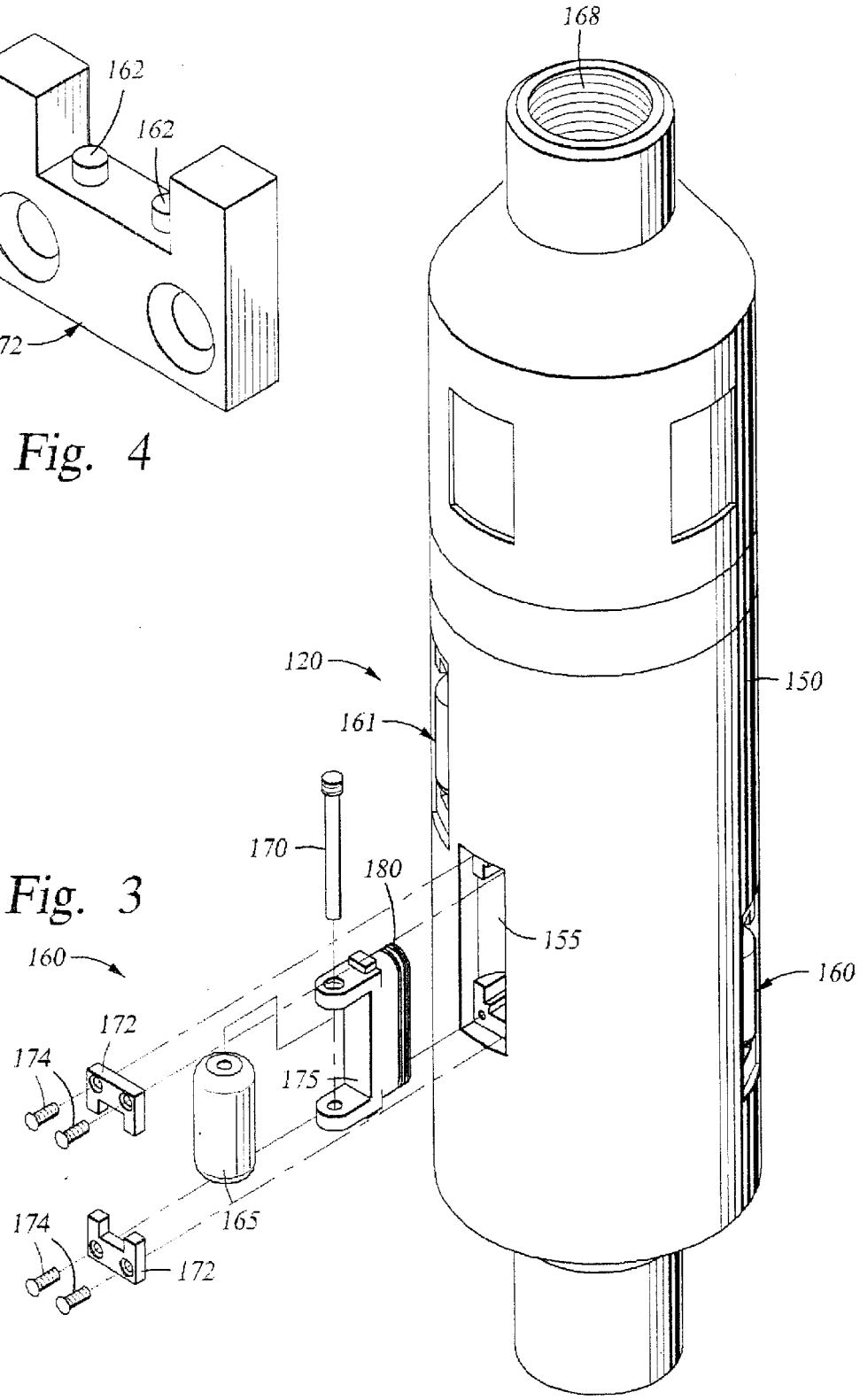
FIG. 3 is an exploded view of an expander tool as might be used in the methods of the present invention.
FIG. 4 is a perspective view showing a shearable connection for an expansion member.

FIG. 3 is an exploded view of the expander tool 120 itself. The expander tool 120 consists of a cylindrical body 150 having a plurality of windows 155 formed therearound. Within each window 155 is an expansion assembly 160 which includes a roller 165 disposed on an axle 170 which is supported at each end by a piston 175. The piston 175 is retained in the body 150 by a pair of retention members 172 that are held in place by screws 174. The assembly 160 includes a piston surface 180 formed opposite the piston 175 which is acted upon by pressurized fluid in the bore 168 of the expander tool 120. The pressurized fluid causes the expansion assembly 160 to extend radially outward and into contact with the inner surface of the lower string of casing 130. With a predetermined amount of fluid pressure acting on the piston surface 180 of piston 175, the lower string of casing 130 is expanded past its elastic limits.

The expander tool 120 illustrated in FIGS. 1 and 3 includes expansion assemblies 160 that are disposed around the perimeter of the expander tool body 150 in a spiraling fashion. Located at an upper position on the expander tool 120 are two opposed expansion assemblies 160 located 180° apart. The expander tool 120 is constructed and arranged whereby the uppermost expansion members 161 are actuated after the other assemblies 160.

In one embodiment, the uppermost expansion members 161 are retained in their retracted position by at least one shear pin 162 which fails with the application of a predetermined radial force. In FIG. 4 the shearable connection is illustrated as two pin members 162 extending from a retention member 172 to a piston 175. When a predetermined force is applied between the pistons 175 of the uppermost expansion members 161 and the retaining pins 162, the pins 162 fail and the piston 175 moves radially outward. In this manner, actuation of the uppermost members 161 can be delayed until all of the lower expansion assemblies 160 have already been actuated.

Figure 5A:
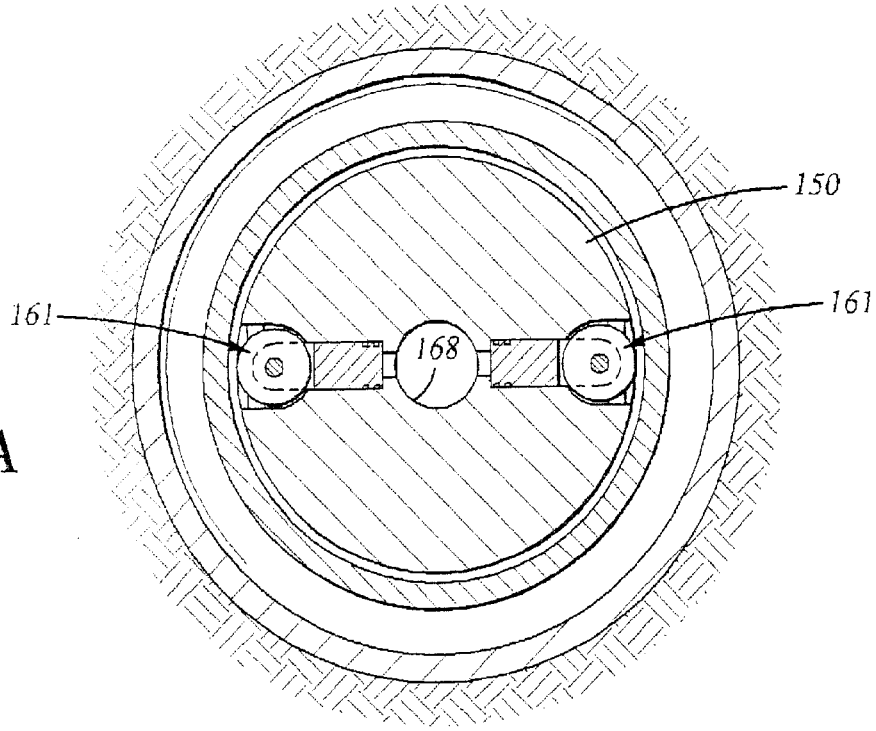
FIGS. 5A–5D are section views taken along a line 5—5 of FIG. 1 and illustrating the position of expansion members during progressive operation of the expansion tool.
Figure 5B:
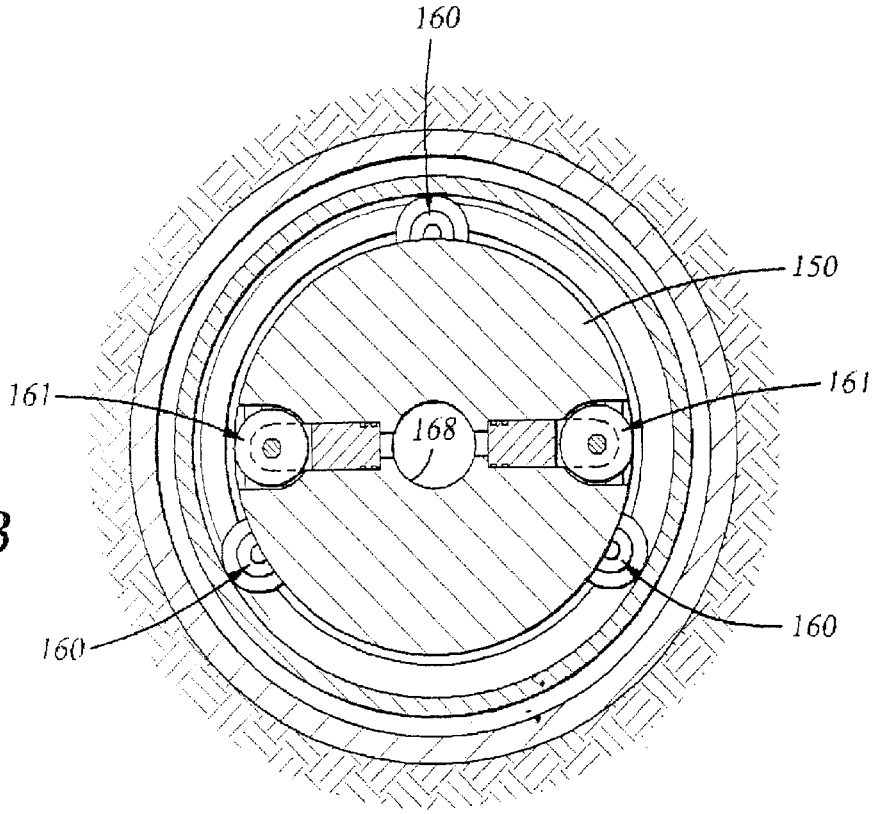

FIGS. 5A–5D are section views of the expander tool 120 taken along lines 5—5 of FIG. 1. The purpose of FIGS. 5A–5D is to illustrate the relative position of the various expansion assemblies 160 and 161 during operation of the expander tool 120 in a wellbore 100. FIG. 5A illustrates the expander tool 120 in the run-in position with all of the radially outward extending expansion assemblies 160, 161 in a retracted position within the body 150 of the expander tool 120. In this position, the expander tool 120 can be run into a wellbore 100 without creating a profile any larger than the outside diameter of the expansion tool body 150. FIG. 5B illustrates the expander tool 120 with all but the uppermost expansion assemblies 160 and 161 actuated. Because the expansion assemblies 160 are spirally disposed around the body 150 at different depths, in FIG. 5B the expander tool 120 would have expanded a portion of the lower string of casing 130 axially as well as radially. In addition to the expansion of the lower string of casing 130 due to the location of the expansion assemblies 160, the expander tool 120 and working string 115 can be rotated relative to the lower string of casing 130 to form a circumferential area of expanded liner 130L. Rotation is possible due to a swivel 138 located above the expander tool 120 which permits rotation of the expander tool 120 while ensuring the weight of the casing 130 is borne by the dogs 135.

Figure 6:
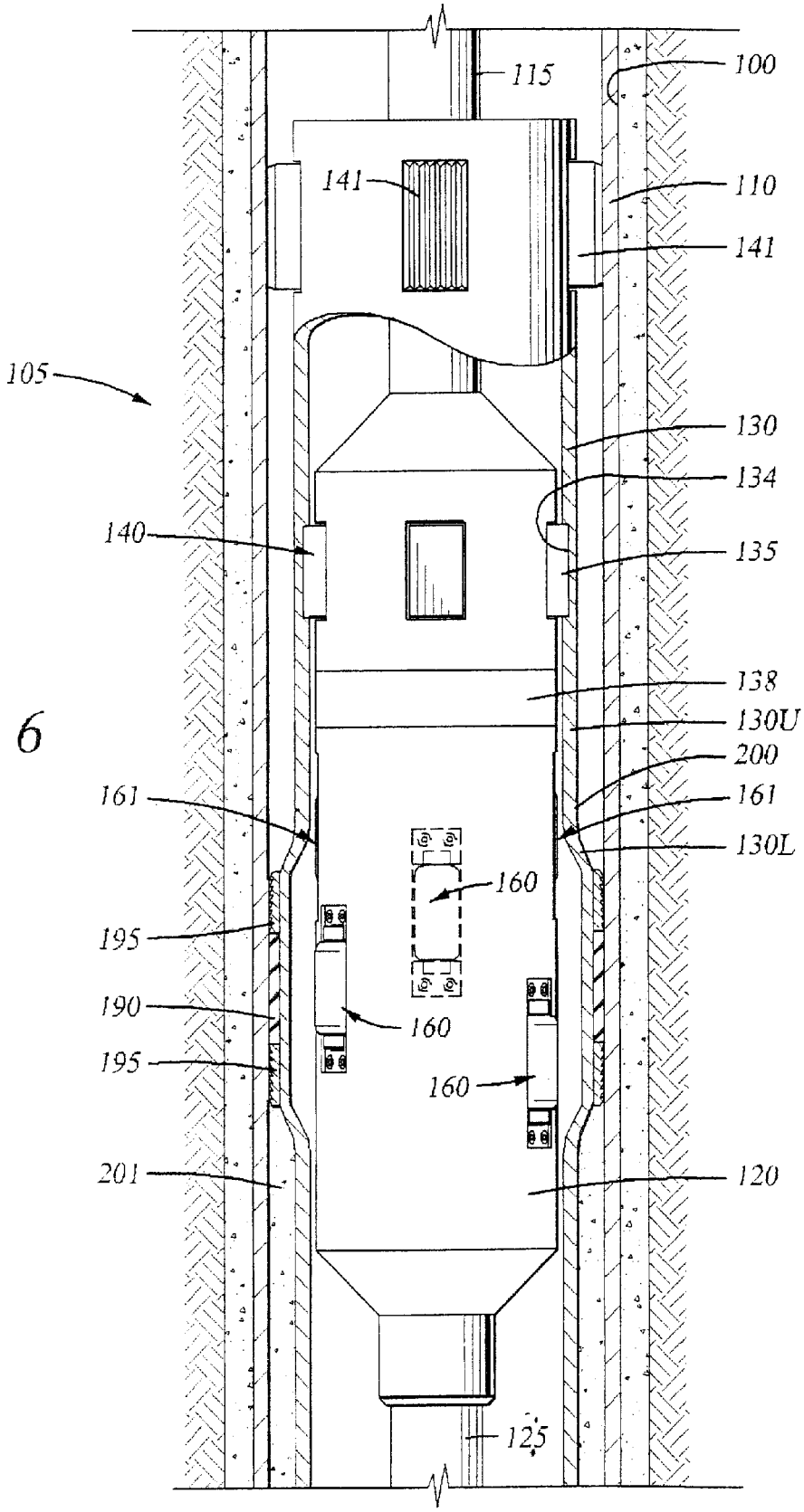
FIG. 6 is a partial section view of the apparatus in a wellbore illustrating a portion of the lower string of casing, including slip and sealing members, having been expanded into the upper string of casing therearound.

FIG. 6 presents a partial section view of the apparatus 105 after expanding a portion of the lower string of casing 130L into the upper string of casing 110. Expansion assemblies 160 have been actuated in order to act against the inner surface of the lower string of casing 130L. Thus, FIG. 6 corresponds to FIG. 5B. Visible also in FIG. 6 is sealing ring 190 in contact with the inside wall of the casing 110. Slips 195 are also in contact with the upper string of casing 110.

Figure 5C:
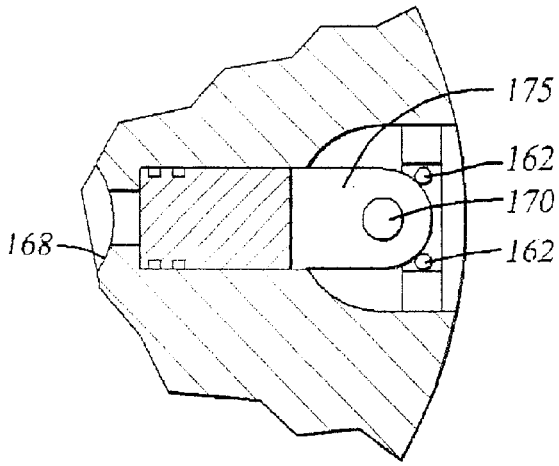

FIG. 5C is a top section view of a top expansion member 160 in its recessed state. Present in this view is a piston 175 residing within the body 150 of the expander tool 120. Also present is the shearable connection, i.e., shear pins 162 of FIG. 4.

Figure 5D:
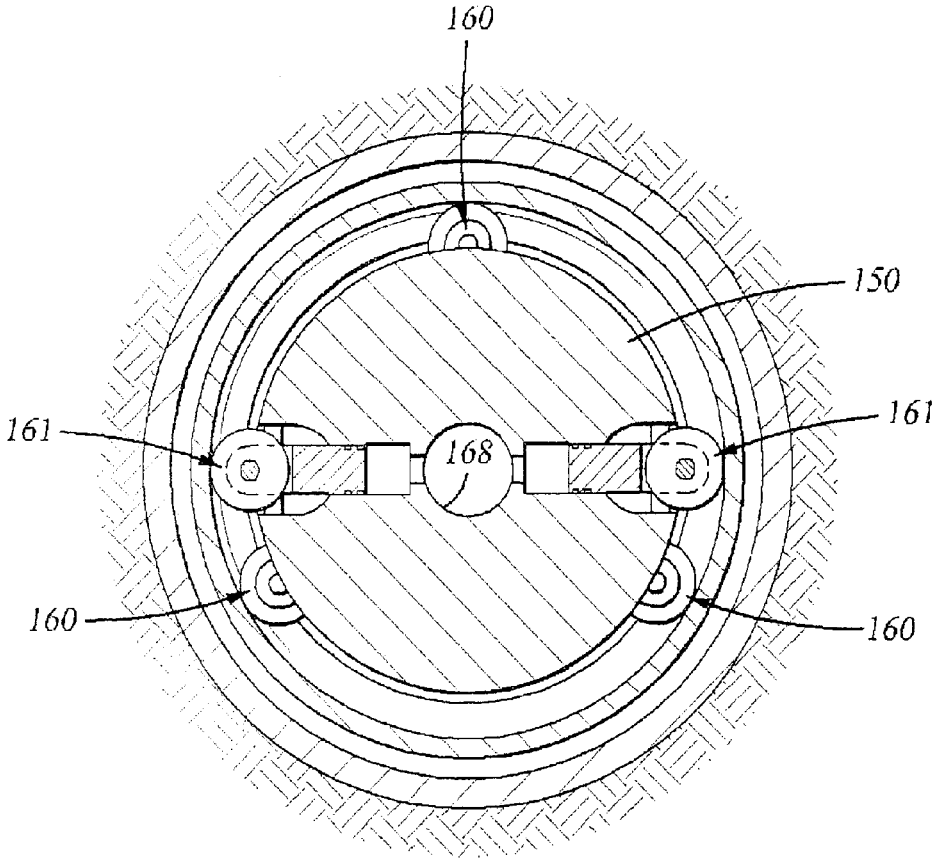

Referring to FIG. 5D, this figure illustrates the expander tool 120 with all of the expansion assemblies 160 and 161 actuated, including the uppermost expansion members 161. As previously stated, the uppermost expansion members 161 are constructed and arranged to become actuated only after the lower assemblies 160 have been actuated.

Figure 7:
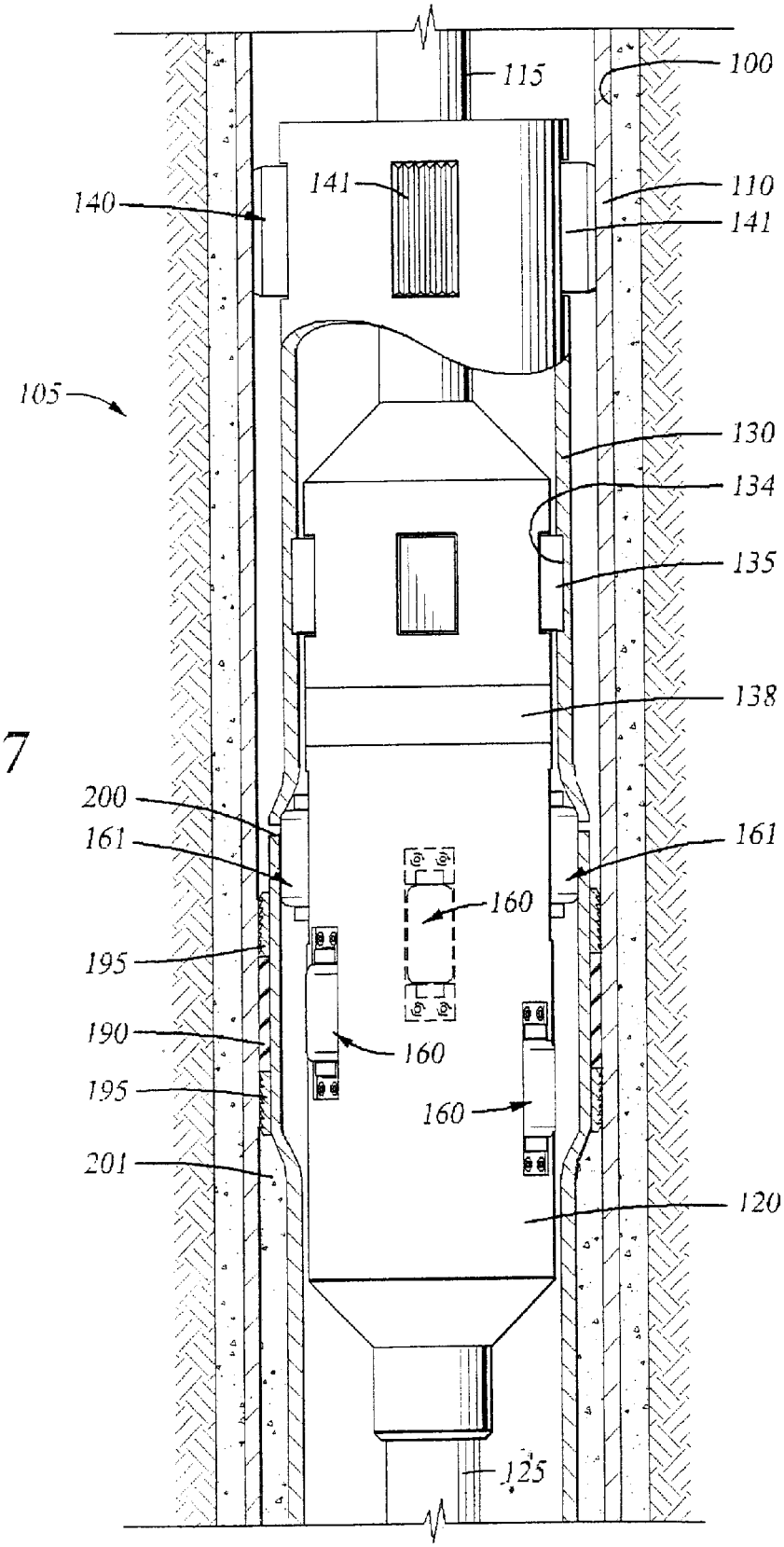
FIG. 7 is a partial section view of the apparatus illustrating the lower string of casing expanded into frictional and sealing engagement with the upper string of casing.

FIG. 7 depicts a wellbore 100 having an expander tool 120 and lower string of casing 130 of the present invention disposed therein. In this view, all of the expansion assemblies 160, 161, including the uppermost expansion members 161, have been actuated. Thus, FIG. 7 corresponds to the step presented in FIG. 5D.

Referring again to FIG. 1, formed on the surface of the lower string of casing 130L adjacent the uppermost expansion member 161 is a scribe 200. The scribe 200 creates an area of structural weakness within the lower casing string 130. When the lower string of casing 130 is expanded at the depth of the scribe 200, the lower string of casing 130 breaks cleanly into upper 130U and lower 130L portions. The upper portion 130U of the lower casing string 130 can then be easily removed from the wellbore 100.

The inventors have determined that a scribe 200 in the wall of a string of casing 130 or other tubular will allow the casing 130 to break cleanly when radial outward pressure is placed at the point of the scribe 200. The depth of the cut 200 needed to cause the break is dependent upon a variety of factors, including the tensile strength of the tubular, the overall deflection of the material as it is expanded, the profile of the cut, and the weight of the tubular being hung. Thus, the scope of the present invention is not limited by the depth of the particular cut or cuts 200 being applied, so long as the scribe 200 is shallow enough that the tensile strength of the tubular 130 supports the weight below the scribe 200 during run-in. The preferred embodiment, shown in FIG. 2, employs a single scribe 200 having a V-shaped profile so as to impart a high stress concentration onto the casing wall.

In the preferred embodiment, the scribe 200 is formed on the outer surface of the lower string of casing 130. Further, the scribe 200 is preferably placed around the casing 130 circumferentially. Because the lower string of casing 130 and the expander tool 120 are run into the wellbore 100 together, and because no axial movement of the expander tool 120 in relation to the casing 130 is necessary, the position of the upper expansion members 161 with respect to the scribe 200 can be predetermined and set at the surface of the well or during assembly of the apparatus 105.

FIG. 7, again, shows the expander tool 120 with all of the expansion assemblies 160 and 161 actuated, including the uppermost expansion members 161. In FIG. 7, the scribe 200 has caused a clean horizontal break around a perimeter of the lower string of casing 130 such that a lower portion of the casing 130L has separated from an upper portion 130U thereof. In addition to the expansion assemblies 160 and 161 having been actuated radially outward, the swivel 138 permitted the run-in string 115 and expansion tool 120 to be rotated within the wellbore 100 independent of the casing 130, ensuring that the casing 130 is expanded in a circumferential manner. This, in turn, results in an effective hanging and sealing of the lower string of casing 130 upon the upper string of casing 110 within the wellbore 100. Thus, the apparatus 105 enables a lower string of casing 130 to be hung onto an upper string of casing 110 by expanding the lower string 130 into the upper string 110.

Figure 8:
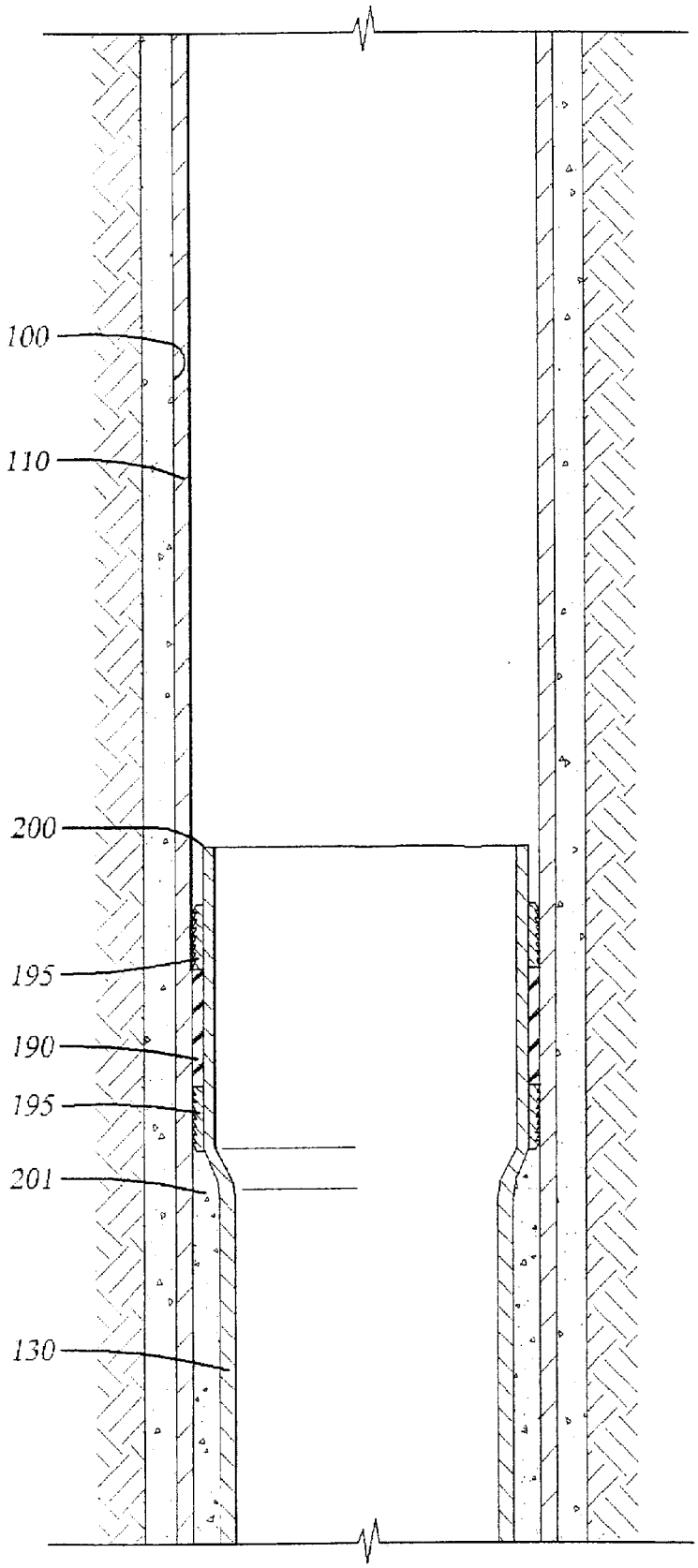
FIG. 8 is a partial section view of the wellbore illustrating a section of the lower casing string expanded into the upper casing string after the expansion tool and run-in string have been removed.

FIG. 8 illustrates the lower string of casing 130 set in the wellbore 100 with the run-in string 115 and expander tool 120 removed. In this view, expansion of the lower string of casing 130 has occurred. The slip rings 195 and the seal ring 190 are engaged to the inner surface of the upper string of casing 110. Further, the annulus 201 between the lower string of casing 130 and the upper string of casing has been filled with cement, excepting that portion of the annulus which has been removed by expansion of the lower string of casing 130.

In operation, the method and apparatus of the present invention can be utilized as follows: a wellbore 100 having a cemented casing 110 therein is drilled to a new depth. Thereafter, the drill string and drill bit are removed and the apparatus 105 is run into the wellbore 100. The apparatus 105 includes a new string of inscribed casing 130 supported by an expander tool 120 and a run-in string 115. As the apparatus 105 reaches a predetermined depth in the wellbore 100, the casing 130 can be cemented in place by injecting cement through the run-in string 115, the expander tool 120 and the tubular member 125. Cement is then circulated into the annulus 201 between the two strings of casing 110 and 130.

With the cement injected into the annulus 201 between the two strings of casing 110 and 130, but prior to curing of the cement, the expander tool 120 is actuated with fluid pressure delivered from the run-in string 115. Preferably, the expansion assemblies 160 (other than the upper-most expansion members 161) of the expander tool 120 extend radially outward into contact with the lower string of casing 130 to plastically deform the lower string of casing 130 into frictional contact with the upper string of casing 110 therearound. The expander tool 120 is then rotated in the wellbore 100 independent of the casing 130. In this manner, a portion of the lower string of casing 130L below the scribe 200 is expanded circumferentially into contact with the upper string of casing 110.

After all of the expansion assemblies 160 other than the uppermost expansion members 161 have been actuated, the uppermost expansion members 161 are actuated. Additional fluid pressure from the surface applied into the bore 168 of the expander tool 120 will cause a temporary connection 162 holding the upper expansion members 161 within the body 150 of the expander tool 120 to fail. This, in turn, will cause the pistons 175 of the upper expansion members 161 to move from a first recessed position within the body 150 of the expander tool 120 to a second extended position. Rollers 165 of the uppermost expansion members 161 then act against the inner surface of the lower string of casing 130L at the depth of the scribe 200, causing an additional portion of the lower string of casing 130 to be expanded against the upper string of casing 110.

As the uppermost expansion members 161 contact the lower string of casing 130, a scribe 200 formed on the outer surface of the lower string of casing 130 causes the casing 130 to break into upper 130U and lower 130L portions. Because the lower portion of the casing 130L has been completely expanded into contact with the upper string of casing 110, the lower portion of the lower string of casing 130L is successfully hung in the wellbore 100. The apparatus 105, including the expander tool 120, the working string 115 and the upper portion of the top end of the lower string of casing 130U can then be removed, leaving a sealed overlap between the lower string of casing 130 and the upper string of casing 110, as illustrated in FIG. 8.

FIGS. 5A–5D depict a series of expansions in sequential stages. The above discussion outlines one embodiment of the method of the present invention for expanding and separating tubulars in a wellbore through sequential stages. However, it is within the scope of the present invention to conduct the expansion in a single stage. In this respect, the method of the present invention encompasses the expansion of rollers 165 at all rows at the same time. Further, the present invention encompasses the use of a rotary expander tool 120 of any configuration, including one in which only one row of roller assemblies 160 is utilized. With this arrangement, the rollers 165 would need to be positioned at the depth of the scribe 200 for expansion. Alternatively, the additional step of raising the expander tool 120 across the depth of the scribe 200 would be taken. Vertically translating the expander tool 120 could be accomplished by raising the working string 115 or by utilizing an actuation apparatus downhole (not shown) which would translate the expander tool 120 without raising the drill string 115.

It is also within the scope of the present invention to utilize a swaged cone (not shown) in order to expand a tubular in accordance with the present invention. A swaged conical expander tool expands by being pushed or otherwise translated through a section of tubular to be expanded. Thus, the present invention is not limited by the type of expander tool employed.

As a further aid in the expansion of the lower casing string 130, a torque anchor may optionally be utilized. The torque anchor serves to prevent rotation of the lower string of casing 130 during the expansion process. Those of ordinary skill in the art may perceive that the radially outward force applied by the rollers 165, when combined with rotation of the expander tool 120 could cause some rotation of the casing 130.

In one embodiment, the torque anchor 140 defines a set of slip members 141 disposed radially around the lower string of casing 130. In the embodiment of FIG. 1, the slip members 141 define at least two radially extendable pads with surfaces having gripping formations like teeth formed thereon to prevent rotational movement. In FIG. 1, the anchor 140 is in its recessed position, meaning that the pads 141 are substantially within the plane of the lower casing string 130. The pads 141 are not in contact with the upper casing string 110 so as to facilitate the run-in of the apparatus 105. The pads 141 are selectively actuated either hydraulically or mechanically or both as is known in the art.

In the views of FIG. 6 and FIG. 7, the anchor 140 is in its extended position. This means that the pads 141 have been actuated to engage the inner surface of the upper string of casing 110. This position allows the lower string of casing 130 to be fixed in place while the lower string of casing 130 is expanded into the wellbore 100.

Figure 9:
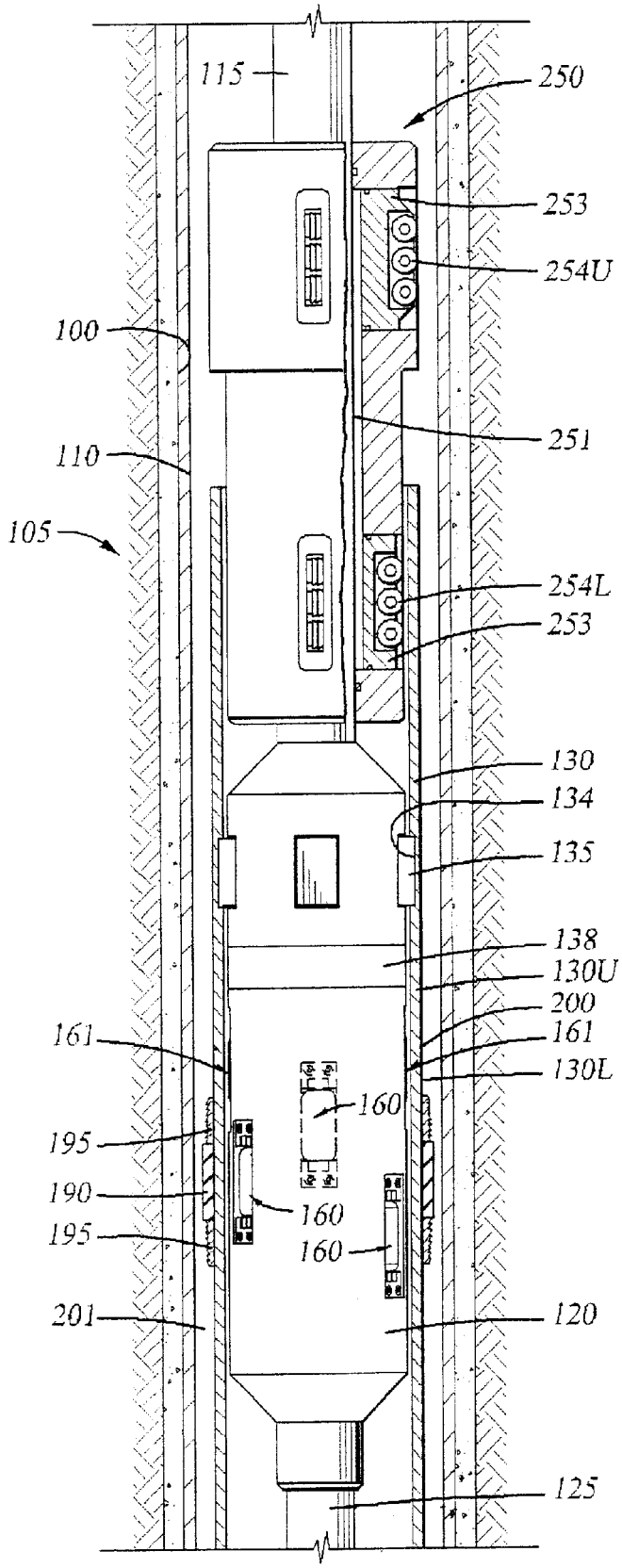
FIG. 9 is a cross-sectional view of an expander tool residing within a wellbore. Above the expander tool is a torque anchor for preventing rotational movement of the lower string of casing during initial expansion thereof. Expansion of the casing has not yet begun.

An alternative embodiment for a torque anchor 250 is presented in FIG. 9. In this embodiment, the torque anchor 250 defines a body having sets of wheels 254U and 254L radially disposed around its perimeter. The wheels 254U and 254L reside within wheel housings 253, and are oriented to permit axial (vertical) movement, but not radial movement, of the torque anchor 250. Sharp edges (not shown) along the wheels 254U and 254L aid in inhibiting radial movement of the torque anchor 250. In the preferred embodiment, four sets of wheels 254U and 254L are employed to act against the upper casing 110 and the lower casing 130, respectively.

Figure 10:
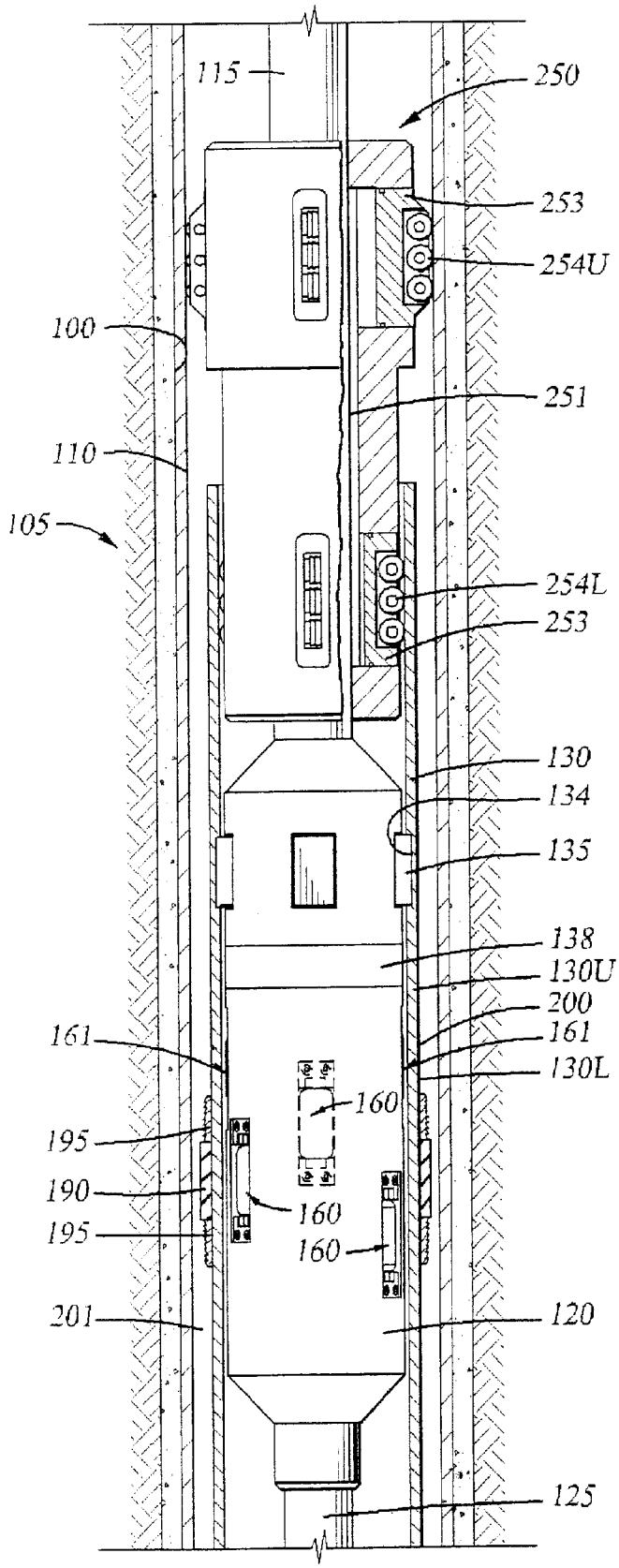
FIG. 10 is a cross-sectional view of an expander tool of FIG. 9. In this view, the torque anchor and expander tool have been actuated, and expansion of the lower casing string has begun.

The torque anchor 250 is run into the wellbore 100 on the working string 115 along with the expander tool 120 and the lower casing string 130. The run-in position of the torque anchor 250 is shown in FIG. 9. In this position, the wheel housings 253 are maintained essentially within the torque anchor body 250. Once the lower string of casing 130 has been lowered to the appropriate depth within the wellbore 100, the torque anchor 250 is activated. Fluid pressure provided from the surface through the working tubular 115 acts against the wheel housings 253 to force the wheels 254C and 254L outward from the torque anchor body 250. Wheels 254C act against the inner surface of the upper casing string 130, while wheels 254L act against the inner surface of the lower casing string 130. This activated position is depicted in FIG. 10.

A rotating sleeve 251 resides longitudinally within the torque anchor 250. The sleeve 251 rotates independent of the torque anchor body 250. Rotation is imparted by the working tubular 115. In turn, the sleeve provides the rotational force to rotate the expander 120.

After the lower casing string 130L has been expanded into frictional contact with the inner wall of the upper casing string 110, the expander tool 120 is deactivated. In this regard, fluid pressure supplied to the pistons 175 is reduced or released, allowing the pistons 175 to return to the recesses 155 within the central body 150 of the tool 120. The expander tool 120 can then be withdrawn from the wellbore 100 by pulling the run-in tubular 115.

While the foregoing is directed to embodiments of the present invention, other and further embodiments of the invention may be devised without departing from the basic scope thereof. In this respect, it is within the scope of the present inventions to expand a tubular having a scribe into the formation itself, rather than into a separate string of casing. In this embodiment, the formation becomes the surrounding tubular. Thus, the present invention has applicability in an open hole environment.

What is claimed is:

1. A method for expanding a second tubular into a first tubular, the first tubular and second tubular each having a top portion and a bottom portion, comprising the steps of:

positioning the first tubular within a wellbore;

placing a scribe within the top portion of the second tubular;

running the second tubular to a selected depth within the wellbore such that the top portion of the second tubular overlaps with the bottom portion of the first tubular;

expanding the top portion of the second tubular at the depth of said scribe so that the outer surface of the expanded top portion of the second tubular is in frictional contact with the inner surface of the bottom portion of the first tubular, and thereby severing the top portion of the second tubular into an upper and lower portion; and removing said severed upper portion of said top portion of the second tubular from the wellbore.

2. The method of claim 1, wherein said scribe imparts a high stress concentration onto the second tubular.

3. The method of claim 2, wherein the first tubular and the second tubular each define a string of casing.

4. The method of claim 3, wherein said scribe defines at least one V-shaped profile.

5. The method of claim 4, wherein said V-shaped profile is circumferentially inscribed around the outer surface of the second tubular.

6. The method of claim 2, wherein the second tubular defines a string of casing, and the first tubular is the formation.

7. The method of claim 1, further comprising the step of expanding the top portion of the second tubular below said scribe before the step of expanding the top portion of the second tubular at the depth of said scribe, so that the outer surface of the expanded top portion of the second tubular is in frictional contact with the inner surface of the bottom portion of the first tubular along a greater length of the top portion of the second tubular.

8. The method of claim 7, wherein said scribe imparts a high stress concentration onto the second tubular.

9. The method of claim 8, wherein said steps of expanding the top portion of the second tubular below said scribe, and expanding the top portion of the second tubular at the depth of said scribe, are conducted by use of a swaged conical expander tool.

10. The method of claim 8, wherein said steps of expanding the top portion of the second tubular below said scribe, and expanding the top portion of the second tubular at the depth of said scribe, are conducted by use of a rotary expander tool having a plurality of rollers.

11. The method for of claim 10, wherein said rotary expander tool has only one row of rollers; and said expander tool is raised from the portion of the second tubular below said scribe, to the portion of the second tubular at the depth of said scribe, during said expansion steps.

12. The method of claim 11, wherein the first tubular and the second tubular each define a string of casing.

13. The method of claim 12, wherein said scribe defines at least one V-shaped profile.

14. The method of claim 13, wherein said at least one V-shaped profile is circumferentially inscribed around the outer surface of the second tubular.

15. The method of claim 8, wherein said steps of expanding the top portion of the second tubular below said scribe, and expanding the top portion of the second tubular at the depth of said scribe, occur essentially simultaneously.

16. An expander tool for expanding a tubular, the tool comprising:

a body having a bore longitudinally formed therein;

at least one first roller member radially extendable from the body into contact with a surrounding inside surface of the tubular; and at least one second roller member constructed and arranged to extend from the body after the at least one first roller member has extended therefrom.

17. The expander tool of claim 16, wherein the at least one first roller member and the at least one second roller member extend due to fluid pressure applied from the bore to a piston surface formed on a roller housing.

18. The expander tool of claim 17, wherein the fluid pressure required to radially extend the at least one second roller member is greater than the fluid pressure required to extend the at least one first roller member.

19. The expander tool of claim 17, wherein a first fluid pressure is applied from the bore to extend the at least one first roller member and a second, increased fluid pressure is applied from the bore to extend the at least one second roller member.

20. The expander tool of claim 17, wherein the fluid pressure causes the piston surface to move from within the body to a radially extended position outside the body.

21. The expander tool of claim 16, wherein the at least one first roller member is radially extendable to expand the tubular.

22. The expander tool of claim 16, wherein a temporary connection prevents the at least one second roller member from extending from the body prior to the at least one first roller member.

23. The expander tool of claim 22, wherein the at least one second roller member is extendable from the body upon application of a predetermined radial force applied from the bore to disconnect the temporary connection.

24. The expander tool of claim 23, wherein the predetermined radial force is fluid pressure.

25. The expander tool of claim 22, wherein the temporary connection is a shearable member.

26. The expander tool of claim 16, wherein a plurality of first roller members are spirally disposed around the body at varying axial locations.

27. A method of expanding a second tubular into a first tubular within a wellbore, comprising:

lowering the second tubular to a selected depth within the wellbore so that a portion of the second tubular overlaps with a portion of the first tubular, a portion of a surface of the second tubular having a scribe therein;

expanding the portion of the second tubular so that an outer surface of the second tubular is in frictional contact with an inner surface of the first tubular at the overlap, thereby severing the second tubular into an upper and lower portion at the scribe; and removing the severed upper portion of the second tubular from the wellbore.

28. An apparatus comprising:

a tubular having an inscribed portion; and an expander tool disposed within the inscribed tubular and connected thereto, the expander tool having at least one first extendable roller members for causing the tubular to fail at the inscribed portion and at least one second extendable roller members, wherein the tubular is disposed within a wellbore and expandable into frictional contact with the wellbore by the at least one second extendable roller member the at least one second extendable roller members extendable prior to the at least one first extendable roller members.

* * * * *